US008457541B2

(12) United States Patent
Kosuge et al.

(10) Patent No.: US 8,457,541 B2
(45) Date of Patent: Jun. 4, 2013

(54) IMAGE FORMING APPARATUS

(75) Inventors: Akio Kosuge, Yokohama (JP); Shinichi Kawahara, Tokyo (JP); Nobuo Kuwabara, Yokohama (JP); Satoshi Hatori, Yokohama (JP); Yoshinori Ozawa, Atsugi (JP); Daisuke Tomita, Yokohama (JP); Takeshi Shintani, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 687 days.

(21) Appl. No.: 12/614,791

(22) Filed: Nov. 9, 2009

(65) Prior Publication Data

US 2010/0129126 A1 May 27, 2010

(30) Foreign Application Priority Data

Nov. 21, 2008 (JP) ..... 2008-297775

(51) Int. Cl.
*G03G 21/00* (2006.01)

(52) U.S. Cl.
USPC ..... 399/350; 399/346; 399/351; 399/354

(58) Field of Classification Search
USPC ..... 399/129, 123, 354, 346, 350, 351
See application file for complete search history.

(56) References Cited

U.S. PATENT DOCUMENTS

| | | | | |
|---|---|---|---|---|
| 7,415,238 | B2 | 8/2008 | Watanabe et al. | |
| 7,610,008 | B2 | 10/2009 | Watanabe et al. | |
| 2002/0018670 | A1 * | 2/2002 | Shoji | 399/174 |
| 2002/0031647 | A1 * | 3/2002 | Sasagawa et al. | 428/189 |
| 2005/0185989 | A1 * | 8/2005 | Kosuge et al. | 399/168 |
| 2007/0003337 | A1 * | 1/2007 | Shakuto et al. | 399/349 |
| 2007/0224528 | A1 * | 9/2007 | Yamashita et al. | 430/66 |
| 2007/0297830 | A1 * | 12/2007 | Kosuge | 399/128 |
| 2008/0056757 | A1 * | 3/2008 | Honobe et al. | 399/100 |
| 2008/0170878 | A1 | 7/2008 | Yamashita et al. | |
| 2008/0193178 | A1 | 8/2008 | Sugimoto et al. | |
| 2008/0193179 | A1 * | 8/2008 | Sugimoto et al. | 399/354 |
| 2008/0253815 | A1 | 10/2008 | Yano et al. | |

(Continued)

FOREIGN PATENT DOCUMENTS

| | | |
|---|---|---|
| JP | 09-211978 | 8/1997 |
| JP | 11-007225 | 1/1999 |

(Continued)

OTHER PUBLICATIONS

Japanese Office Action issued by the Japan Patent Office on Feb. 8, 2013 for Japanese Application No. 2009-046397.

*Primary Examiner* — David Gray
*Assistant Examiner* — Thomas Giampaolo, II
(74) *Attorney, Agent, or Firm* — Oblon, Spivak, McClelland, Maier & Neustadt, L.L.P.

(57) ABSTRACT

An image forming apparatus includes an image carrier, a charging device to charge a surface of the image carrier, disposed across a predetermined gap from the image carrier, a latent image forming device, a developing device to develop a latent image formed on the image carrier into a toner image, a transfer unit to transfer the toner image from the image carrier onto a recording medium, a cleaning member to clean the image carrier after the toner image is transferred therefrom, a lubricant application member to lubricate the image carrier, a polarity adjustor to adjust polarities of the toner and lubricant adhering to the image carrier to be identical to a polarity of a charging bias. The polarity adjustor is disposed facing the image carrier, upstream from the charging device and downstream from the transfer unit in a direction in which the image carrier rotates.

16 Claims, 4 Drawing Sheets

U.S. PATENT DOCUMENTS

| | | | | |
|---|---|---|---|---|
| 2008/0292354 | A1* | 11/2008 | Shinkawa et al. | 399/100 |
| 2008/0304843 | A1* | 12/2008 | Kosuge et al. | 399/50 |
| 2008/0310897 | A1 | 12/2008 | Naruse et al. | |
| 2009/0035038 | A1* | 2/2009 | Sugimoto et al. | 399/354 |
| 2009/0060554 | A1* | 3/2009 | Kosuge et al. | 399/71 |
| 2009/0092428 | A1* | 4/2009 | Yano et al. | 399/349 |
| 2009/0304423 | A1* | 12/2009 | Ozaki et al. | 399/346 |

FOREIGN PATENT DOCUMENTS

| | | |
|---|---|---|
| JP | 11-38848 | 2/1999 |
| JP | 11-231609 | 8/1999 |
| JP | 2001-042732 | 2/2001 |
| JP | 2002-132022 | 5/2002 |
| JP | 2004-77882 | 3/2004 |
| JP | 2006-113511 | 4/2006 |
| JP | 2006-259466 | 9/2006 |
| JP | 2007-310336 | 11/2007 |
| JP | 2008-040137 | 2/2008 |
| JP | 2008-58413 | 3/2008 |
| JP | 2008-170616 | 7/2008 |

* cited by examiner

IMAGE FORMING APPARATUS

CROSS-REFERENCE TO RELATED APPLICATIONS

This patent specification claims priority from Japanese Patent Application No. 2008-297775, filed on Nov. 21, 2008 in the Japan Patent Office, which is hereby incorporated by reference herein in its entirety.

BACKGROUND OF THE INVENTION

1. Field of the Invention

The present invention generally relates to an image forming apparatus such as a copier, a printer, a facsimile machine, or a multifunction machine including at least two of these functions.

2. Discussion of the Background

In general, electrophotographic image forming apparatuses, such as copiers, printers, facsimile machines, and multifunction machines including at least two of these functions, include a charging device to charge the surface of an image carrier such as a photoconductor uniformly, a writing unit to direct writing light onto the surface of the image carrier to form an electrostatic latent image thereon, and a developing device to develop the latent image with toner into a toner image. Then, the toner image is transferred from the image carrier onto a sheet of recording media either directly or indirectly in a transfer process, after which a cleaning member such as a cleaning brush or cleaning blade removes any toner (hereinafter "residual toner") remaining on the surface of the image carrier.

The charging device is conventionally a charging roller disposed to contact the image carrier, and a charging bias is applied to the charging roller so as to charge the image carrier to a given electrical potential. However, in this configuration, because the image carrier and the charging roller rotate while in constant contact with each other, the residual toner and lubricant applied onto the image carrier tends to adhere to the charging roller. The toner and lubricant adhering to the charging roller can inhibit a uniform electrical discharge between the image carrier and the charging roller, and thus the image carrier cannot be charged properly, which is hereinafter referred to as "charging failure". Charging failure causes substandard images in which image density is uneven, toner is partly absent creating white lines, or line-like stains are present.

In view of the foregoing, several approaches described below, have been advanced to reduce the adherence of toner and lubricant to the charging roller.

For example, in certain known image forming apparatuses, the charging roller is disposed across a given small gap from the image carrier so as to reduce adherence of the toner and the lubricant to the charging roller. However, although the adherence of the toner and the lubricant to the charging roller may be smaller when the charging roller does not contact the image carrier, it is still possible that the toner may be electrostatically transferred from the surface of the image carrier across the small gap to the charging roller.

In another known image forming apparatuses, the cleaning blade to remove the toner and the lubricant from the image carrier is double-layered and includes an electroconductive portion. A DC (direct current) bias that is lower than a discharge start voltage at which electrical discharge is started between the image carrier and the cleaning blade is applied to the cleaning blade to electrostatically attract particles of external additive to toner mother particles. The polarity of the external additive is the opposite of the polarity of the toner mother particles, and thus the DC bias applied to the cleaning blade has a polarity identical to that of the toner mother particles. However, although the cleaning blade can attract the particles whose polarity is the opposite of the polarity of the toner mother particles, other particles can adhere to the charging roller.

Yet another known image forming apparatus includes the charging roller disposed to contact the image carrier, and a charge adjustment member that charges the residual toner to have a polarity identical to that of the bias to charge the image carrier before the charging roller charges the image carrier to a given electrical potential. This known image forming apparatus is a cleaner-less type without the cleaning member to clean the surface of the image carrier, and the development device collects the residual toner whose polarity has been adjusted. However, because the charging roller contacts the image carrier, the residual toner can physically adhere to the charging roller.

In view of the foregoing, there is a need to reduce the adherence of the toner, the lubricant, etc., to the charging roller so as to prevent charging failure as well as to attain satisfactory image quality for a longer time period, which the known image forming apparatuses fail to do.

SUMMARY OF THE INVENTION

In view of the foregoing, in one illustrative embodiment of the present invention, an image forming apparatus includes an image carrier to carry a toner image thereon, a charging device to charge a surface of the image carrier, disposed across a predetermined gap from the surface of the image carrier, a latent image forming device to form a latent image on the charged surface of the image carrier, a developing device to develop the latent image with toner into a toner image, a transfer unit to transfer the toner image from the image carrier onto a sheet of recording media, a first cleaning member to clean the surface of the image carrier after the toner image is transferred therefrom, a lubricant application member to apply lubricant onto the surface of the image carrier, and a polarity adjustor to adjust polarities of the toner and lubricant adhering to the image carrier to be identical to a polarity of a charging bias with which the charging device charges the image carrier. The polarity adjustor is disposed facing the image carrier, upstream from the charging device and downstream from the transfer unit in a direction in which the image carrier rotates.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
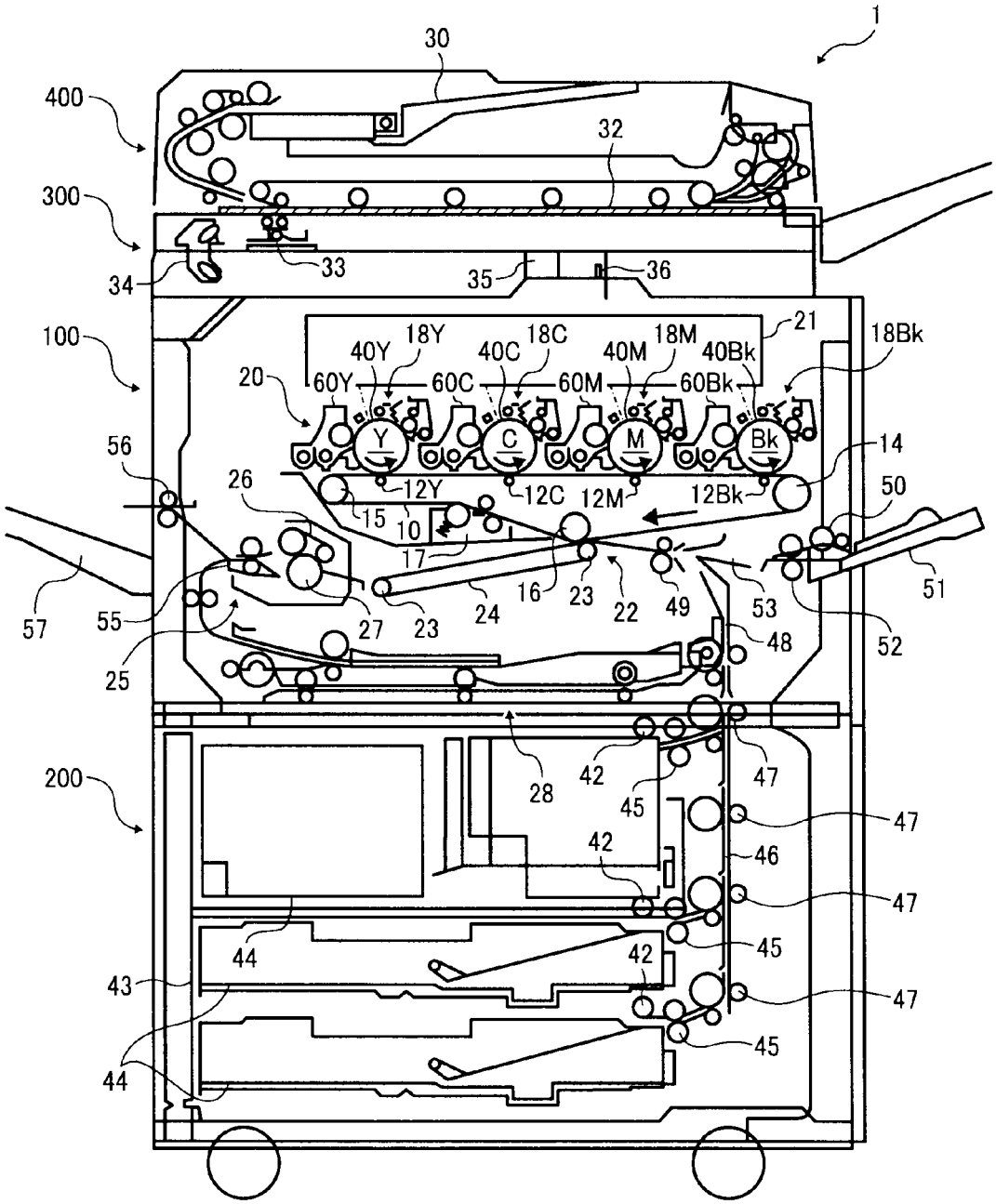
FIG. 1 illustrates a schematic configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an example embodiment of the present invention is described.

FIG. 1 schematically illustrates a configuration of an image forming apparatus 1 that in the present embodiment is a tandem-type intermediate-transfer multicolor copier. The image forming apparatus 1 includes a main body 100, a sheet feeder 200 containing sheets of recording media such as paper, film, and the like, on which the main body 100 is disposed, a scanner 300 disposed above the main body 100, and an automatic document feeder (ADF) 400 disposed above the scanner 300.

A tandem image forming device 20 is disposed in a center portion of the main body 100 and includes four image forming units 18Y, 18C, 18M, and 18Bk arranged laterally. It is to be noted that reference characters Y, C, M, and Bk represent yellow, cyan, magenta, and black, respectively. Also, the subscripts Y, C, M, and Bk attached to the end of reference numerals indicate only that components indicated thereby are used for forming yellow, cyan, magenta, and black toner images, respectively, and may be omitted when color discrimination is not required in the description below.

The image forming units 18Y, 18C, 18M, and 18Bk respectively include photoconductors 40Y, 40C, 40M, and 40Bk serving as image carriers on which yellow, cyan, magenta, and black toner images are formed.

An exposure unit 21 is provided above the tandem image forming device 20. The exposure unit 21 include four light sources such as laser diodes for Y, C, M, and Bk, respectively, a polygon scanner, and mirrors and lenses, such as an f-θ lens and a long toroidal lens (WTL), that are disposed in the light path of each light source. The polygon scanner includes a hexagonal polygon mirror and a polygon motor. Laser beams emitted from the light sources according to image date for Y, C, M, and Bk are deflected by the polygon mirror to scan across surfaces of the respective photoconductors 40, and then electrostatic latent images are formed thereon. Thus, the exposure unit 21 serves as a latent image forming device.

An intermediate transfer belt 10 is disposed beneath the tandem image forming device 20, wound around three support rollers 14, 15, and 16, and can rotate clockwise in the configuration shown in FIG. 1. The support roller 14 serves as a driving roller to rotate the intermediate transfer belt 10. Between the support rollers 14 and 15, primary transfer rollers 12Y, 12C, 12M, and 12Bk are provided to face the respective photoconductors 40Y, 40C, 40M, and 40Bk via the intermediate transfer belt 10. Each primary transfer roller 12 serves as a primary transfer member to transfer the toner image formed on the corresponding photoconductor 40 onto the intermediate transfer belt 10 in a primary transfer process. Further, a belt cleaning unit 17 to remove toner remaining on the intermediate transfer belt 10 is provided downstream from the support roller 16 in a direction in which the intermediate transfer belt 10 rotates (hereinafter "rotation direction of the intermediate transfer belt 10")

The intermediate transfer belt 10 can be a seamless belt formed of resin such as polyvinylidene fluoride, polyimide, polycarbonate, polyethylene terephthalate, or etc. These materials can be used as is, or an electroconductive material such as carbon black can be added thereto to adjust their electrical resistance. Additionally, the intermediate transfer belt 10 can be either a single-layered belt or a multilayered belt including a base formed of the above-described resin and an outer layer formed through splaying, dipping, or the like.

Beneath the intermediate transfer belt 10, a secondary transfer unit 22 is provided. In the configuration shown in FIG. 1, the secondary transfer unit 22 includes an endless secondary transfer belt 24 looped around two rollers 23. The secondary transfer belt 24 is pressed against the support roller 16 via the intermediate transfer belt 10, forming a secondary transfer nip where the toner image is transferred from the intermediate transfer belt 10 onto the sheet. The secondary transfer belt 24 can be formed of a material similar to the material for the intermediate transfer belt 10. The intermediate transfer belt 10, the primary transfer rollers 12, and the secondary transfer unit 22 together form a transfer unit configured to transfer the toner image from the image carrier onto the sheet of recording media.

The secondary transfer unit 22 also functions as a sheet transport member to transport the sheet carrying the toner image to a fixing device 25 that is provided on a side of the secondary transfer unit 22 and fixes the toner image on the sheet. Needless to say, alternatively, the secondary transfer unit 22 can be a transfer roller or a transfer charger. In such cases, a separate member to transport the sheet to the fixing device 25 is necessary. The fixing device 25 includes an endless fixing belt 26 and a pressure roller 27 pressed against the fixing belt 26.

In the configuration shown in FIG. 1, the main body 100 further includes a reverse unit 28 disposed beneath the secondary transfer unit 22 and the fixing device 25, in parallel to the tandem image forming device 20. The reverse unit 28 reverses the sheet so as to discharge the sheet with its image surface, that is, the surface on which an image is formed, faced down or to feed the sheet again to the secondary transfer nip in duplex printing, in which images are formed on both sides of the sheet.

The main body 100 further includes a pair of registration rollers 49, a feed roller 50, a manual feed tray 51, a separation roller 52, and a pair of discharge rollers 56.

The sheet feeder 200 includes multiple transport rollers 47 and a paper bank 43. Multiple sheet cassettes 44 each containing multiple sheets are vertically arranged in the paper bank 43. Each sheet cassette 44 is provided with a feed roller 42 and a separation roller 45 to forward the sheets one by one to a sheet feed path 46.

Description will be made below of copying processes using the above-described image forming apparatus 1.

Referring to FIG. 1, users can set original documents on a document table 30 of the ADF-400. Alternatively, the user may lift the ADF 400, set an original document on a contact glass 32 of the scanner 300, and then lower the ADF 400 so as to hold the original document with the ADF 400.

When the user presses a start button in an operation unit, not shown, the original document sets in the ADF 400 is forwarded onto the contact glass 32, and then the scanner 300 drives a first carriage 33 and a second carriage 34. By contrast, when the original document is set on the contact glass 32, the scanner 300 immediately drives the first carriage 33 and the second carriage 34.

Subsequently, the first carriage 33 directs an optical beam from the light source onto the original document, and then the optical beam is reflected on a surface of the original document to the second carriage 34. Further, reflected by a mirror of the second carriage 34, the optical beam passes through an imaging lens 35 and then enters a reading sensor 36, and thus the reading sensor 36 obtains the image data of the original document. Subsequently, the image forming apparatus 1 starts image formation in either a multicolor mode or a monochrome mode according to a mode set by the user via the operation panel or according to the image data obtained through the image reading when an automatic mode selection is set on the operation panel.

In the main body 100, when the multicolor mode is selected, while each photoconductor 40 rotates counterclockwise in FIG. 1, a charging roller 70 (shown in FIG. 3) serving as a charging device uniformly charges a surface of each photoconductor 40. The image data obtained by the scanner 300 is decomposed into yellow, cyan, magenta, and black single-color image data, and the exposure unit 21 directs laser beams onto the surfaces of the photoconductors 40 according to the single-color image data, respectively, thus forming electrostatic latent images on the respective photoconductors 40.

As the photoconductors 40 rotate, the electrostatic latent images are then developed with developers (e.g., toner) by developing devices 60, respectively into yellow, cyan, magenta, and black single-color toner images. As the intermediate transfer belt 10 rotates, the respective toner images are sequentially transferred from the photoconductors 40 and superimposed one on another on the intermediate transfer belt 10, thus forming a multicolor (e.g., full-color) toner image. After the toner image is transferred from each photoconductor 40 a discharge lamp 72 (shown in FIG. 3) removes the electrical potential remaining on the photoconductor 40 and a cleaning device including brush rollers 73 and 74, cleaning blade 75 (shown in FIG. 3) removes any toner remaining thereon.

While the multicolor toner image is thus formed, in the sheet feeder 200, one of the feed rollers 42 is selectively driven so that the sheets are fed from the corresponding sheet cassette 44. Then, the sheets are forwarded by the separation roller 45 one by one to the sheet feed path 46 and further transported by the transport rollers 47 to a feed path 48 in the main body 100. Alternatively, the feed roller 50 feeds the sheets on the manual feed tray 51, and then the separation roller 52 forwards the sheets one by one to a manual feed path 53.

Subsequently, the registration rollers 49 stop the sheet by sandwiching its leading edge portion therebetween and then rotate to send the sheet to the secondary transfer nip, where the intermediate transfer belt 10 presses against the secondary transfer unit 22, in synchronization with movement of the multicolor toner image formed on the intermediate transfer belt 10. In the secondary transfer nip, the multicolor toner image is transferred from the intermediate transfer belt 10 onto a first side (e.g., front side) of the sheet due to a transfer electrical field and contact pressure between the intermediate transfer belt 10 and the secondary transfer belt 24.

After the toner image is thus recorded on the sheet, the secondary transfer belt 24 transports the sheet to the fixer 25, where the toner image is fixed thereon with heat and the pressure between the pressure roller 27 and the fixing belt 26. Then, a switching pawl 55 guides the sheet to the pair of discharge rollers 56 that discharges the sheet onto the discharge tray 57.

By contrast, in duplex printing, after the toner image is fixed on the first side of the sheet, the switch claw 55 guides the sheet to the sheet reverse unit 28, where the sheet is reversed and then forwarded again to the secondary transfer nip. Subsequently, another image is formed on a second side of the sheet, and then the sheet is discharged onto the discharge tray 57. When a job of forming images on multiple sheets is instructed, the above-described process is repeated.

After images are formed on a given number of sheets, that is, the job is completed, a post-printing operation is performed on the photoreceptors 40 and then the photoconductors 40 is stopped rotating. In the post-printing operation, the photoconductors 40 are rotated for more than one revolution with a charging bias as well as a transfer bias turned off. While the photoconductors 40 thus rotate, the discharge lamps 72 remove the remaining electrical potential therefrom so as to prevent deterioration of the photoconductors 40.

When the monochrome mode is selected, the support roller 15 moves down in FIG. 1 so that the intermediate transfer belt 10 is disengaged from the photoconductors 40Y, 40C, and 40M. Then, only the photoconductor 40Bk rotates counterclockwise in FIG. 1, the charging roller 70 (shown in FIG. 3) charges the surface of the photoconductor 40Bk uniformly, and then the exposure unit 21 directs the laser beam corresponding to image data onto the photoconductor 40Bk, forming an electrostatic latent image for black. The latent image is then developed into a black image, and the black image is transferred from the photoconductor 40Bk onto the intermediate transfer belt 10. At this time, the photoconductors 40Y, 40C, and 40M and the developing devices 60Y, 60C, and 60M are not activated so as to prevent unnecessary wear thereof and waste of the developers contained in the developing devices 60Y, 60C, and 60M.

Then, the black toner image is transferred on the sheet and the sheet is discharged outside the image forming apparatus 1 in the process similar to those performed in the multicolor mode.

Figure 2:
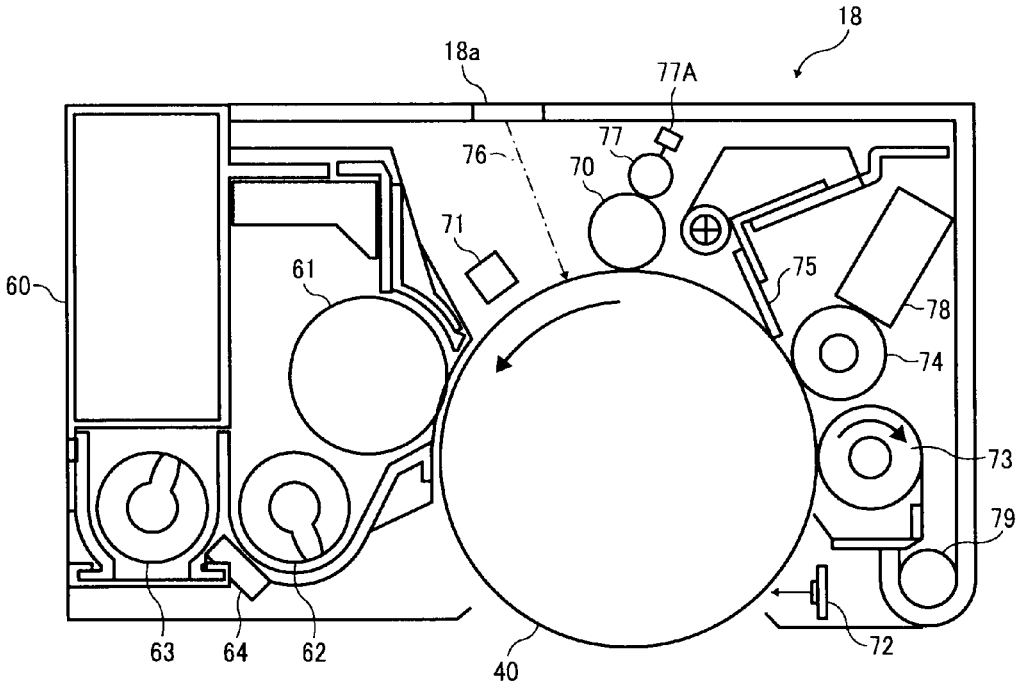
FIG. 2 illustrates a configuration of an image forming unit according to an illustrative embodiment.

FIG. 2 schematically illustrates a configuration of each image forming unit 18.

As shown in FIG. 2, the image forming unit 18 includes the photoconductor 40, the charging roller 70, the developing device 60, an electrical potential detector 71 to detect the electrical potential of the photoconductor 40, the discharge lamp 72, and the cleaning unit including the cleaning members, namely, the brush rollers 73 and 74, and the cleaning blade 75 that is formed of urethane rubber. The brush roller 73 may serve as a first cleaning member. An opening 18*a* is formed in a housing of the image forming unit 18 so that an exposure light 76 can enter the image forming unit 18. Additionally, a cleaning roller 77 configured to clean a surface of the charging roller 70 contacts the surface of the cleaning roller 70.

The housing of the image forming unit 18 holds these components as a single unit, and thus the image forming unit 18 serves as a process cartridge insertable in and removable from the image forming apparatus 1. The image forming unit 18 can be replaced as a whole, alternatively, each component thereof can be configured to be replaceable independently.

The cleaning unit removes the toner, paper dust, etc., adhering to the photoconductor 40. On the surface of the photoconductor 40, the residual toner that is not transferred onto the intermediate transfer belt 10 in the primary transfer process can present. In addition, in multicolor image formation, it is possible that the toner forming the toner image transferred onto the intermediate transfer belt 10 from the photoconductor 40 (e.g., 40Y) disposed on the upstream side may reversely transferred onto the photoconductor 40 (e.g., 40Bk) disposed on the downstream side in the rotation direction of the intermediate transfer belt 10, which is hereinafter referred to "reversely-transferred toner".

The brush roller 74 contacts a solid lubricant member 78 and also serves as a lubricant application member to apply lubricant from the lubricant member 78 onto the surface of the photoconductor 40. Examples of the solid lubricant member 78 include fatty acid metal salt such as zinc stearate, barium stearate, iron stearate, nickel stearate, cobalt stearate, stearate copper, strontium stearate, calcium stearate, magnesium stearate, zinc oleate, oleic acid cobalt, oleic acid magnesium, palmitic acid zinc salt; natural wax such as carnauba wax; and fluorinated resin such as polytetrafluoroethylene.

Applying the lubricant onto the surface of the photoconductor 40 with the brush roller 74 can reduce frictional resistance between the photoconductor 40 and the cleaning blade 75 caused by the sliding contact therebetween and accordingly can reduce wear of the surface of the photoconductor 40. By using the lubricant including stearate zinc as a main composition, wear of the photoconductor 40 can be reduced, expanding its operational life, even when proximity discharge is performed using the organic photoconductor 40. Additionally, fictional resistance between the photoconductor 40 and the substance such as the toner and paper dust from the photoconductor 40 can be also reduced, which facilitates removal of the toner and the like adhering to the photoconductor 40 by the brush rollers 73 and 74, and the cleaning blade 75. Thus, the photoconductor 40 can be better cleaned. The cleaning blade 75 can distribute the lubricant uniformly across the surface of the photoconductor 40 while removing the residual toner and excessive lubricant therefrom, thus serving as a second cleaning member. Further, the cleaning blade 75 is electroconductive (hereinafter also "electroconductive blade 75") and is used to adjust the polarity of the toner adhered on the photoconductor 40, which is described below with reference to FIG. 7.

The toner removed from the photoconductor 40 by the brush rollers 73 and 74 and the cleaning blade 75 is collected by a toner transport coil 79 and then transported to a waste-toner container, not shown.

It is to be noted that, although, in the image forming unit 18 shown in FIG. 2, after the toner image is transferred from the photoconductor 40 onto the intermediate transfer belt 10, the discharge lamp 72 discharges the surface thereof, and then the surface of the photoconductor 40 is cleaned by the brush rollers 73 and 74 and the cleaning blade 75, the order of discharging and cleaning can be reversed.

The developing devices 60Y, 60C, 60M, and Bk use two-component developers including toner and magnetic carriers and have an identical or similar configuration except the color of the toner used therein. Each developing device 60 includes a developing roller 61 disposed facing the photoconductor 40, screws 62 and 63 configured to agitate and transport the developer, and a toner concentration sensor 64. The developing roller 61 includes a rotary sleeve and magnets fixed inside the sleeve. According to outputs from the toner concentration sensor 64, the toner is supplied from a toner supply unit, not shown, to the developing device 60 as required.

When the lubricant application member (brush roller 74) is disposed within the cleaning unit for the photoconductor 40 as in the configuration shown in FIG. 2, for example, disposed downstream from the brush roller 73 and upstream from the cleaning blade 75 in the direction in which the photoconductor 40 rotates, it is possible that the toner entering the cleaning device may adversely affect lubrication of the surface of the photoconductor 40. More specifically, because the brush roller 74 serving as the lubricant application member is disposed in the cleaning unit, efficiency of applying lubricant from the lubricant member 78 onto the surface of the photoconductor 40 can be adversely affected when the amount of the toner (e.g., residual toner and reversely-transferred toner) entering the cleaning unit fluctuates depending on the area of the toner image formed on the photoconductor 40.

In view of the foregoing, a variation of the configuration of the image forming unit is described below with reference to FIG. 3.

Figure 3:
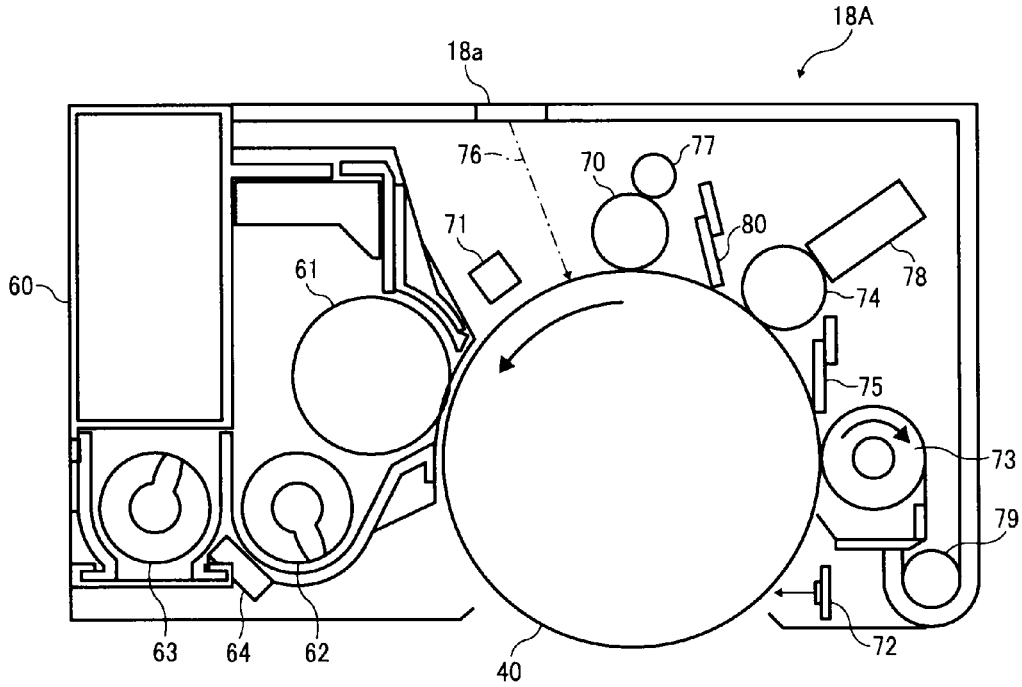
FIG. 3 illustrates another configuration of the image forming unit according to an illustrative embodiment.

FIG. 3 illustrates a configuration of an image forming unit 18A that is different from the image forming unit 18 shown in FIG. 2 in that the brush roller 74 serving as the lubricant application member, the solid lubricant member 78, and a lubricant regulation blade 80 serving as a lubricant regulation member are disposed downstream from the cleaning blade 75 in the rotation direction of the photoconductor 40. In this configuration, even when the amount of the residual toner as well as the reversely-transferred toner fluctuates, the surface of the photoconductor 40 can be reliably lubricated. In the configuration shown in FIG. 3, brush rollers 73 and 74 the cleaning blade 75 serve as cleaning members, and the lubricant regulation blade 80 is electroconductive (hereinafter also "electroconductive blade 80") and is used to adjust the polarity of the toner.

Description will be made below of the charging roller 70 with reference to FIG. 4.

Figure 4:
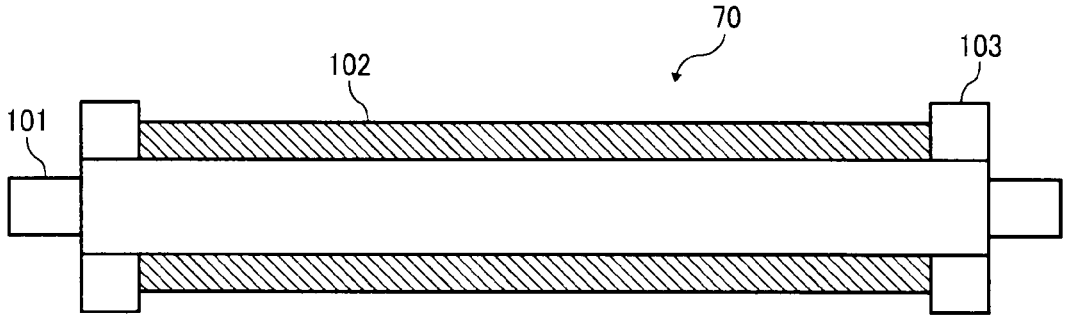
FIG. 4 is a schematic view illustrating a configuration of a charging roller

FIG. 4 illustrates a configuration of the charging roller 70 according to the present embodiment.

In the present embodiment, the charging roller 70 is disposed across a predetermined or given gap, for example, not larger than about 100 μm, from the photoconductor 40 and includes a metal core 101 that is an electroconductive support member, a resin layer or charging layer 102 serving as a charging member, and gap retaining members 103 to maintain the gap between the charging roller 70 and the photoconductor 40. The metal core 101 is formed of metal such as stainless steel. If the metal core 101 has a relatively small diameter, during cutting processing and/or when the charging roller 70 is pressed against the photoconductor 40, the charging roller 70 can deform to an extent not to be disregarded, and thus necessary degree of accuracy in manufacturing and accuracy in the size of the gap may not achieved. By contrast, when the metal core 101 has a relatively large diameter, the charging roller 70 becomes larger and heavier accordingly, which is not desirable. Therefore, in the present embodiment, the diameter of the metal core 101 is preferably within a range from 6 mm to 10 mm.

It is preferable that the resin layer 102 is formed of a resin material having a volume resistivity of within a range from $10^4$ to $10^9$ Ω·cm. If the volume resistivity is lower, the charge bias is likely to leak when the photoconductor 40 has a defect such as a pinhole or the like. By contrast, if the volume resistivity is higher, it is difficult to attain a sufficient electrical discharge, and accordingly the charging roller 70 fails to charge the photoconductor 40 uniformly. The volume resistivity of the resin layer 102 can be adjusted to a desirable value by adding an electroconductive material to the base resin. By forming the charging layer 102 with the resin material, the hardness of the charging layer 102 changes less depending on changes in temperature, and a constant charging gap can be maintained reliably between the photoconductor 40 and the charging layer 102 regardless of the changes in the environment.

Examples of the resin used for the resin layer 102 include polyethylene, polypropylene, polymethyl methacrylate, polystyrene, acrylonitrile-butadiene-styrene copolymer, and polycarbonate. These resins can be easily molded.

As the electroconductive material, ion-conductive materials such as high molecular compounds having a quaternary ammonium base are preferable. Examples of polyolefin having a quaternary ammonium base includes polyolefin such as polyethylene, polypropylene, polybutene, polyisoprene, ethylene ethyl acrylate copolymer, ethylene methyl acrylate copolymer, ethylene vinyl acetate copolymer, ethylene propylene copolymer, and ethylene hexene copolymer. Although polyolefin having a quaternary ammonium base is used in the present embodiment, other high molecular compounds can be also used.

The above-described ion conductive material is uniformly mixed in the base resin using a kneader such as a biaxial kneader, for example. Then, the mixture is applied on the metal core 101 through injection molding or extrusion molding, and thus the resin layer 102 can be shaped into a roller relatively easily. A preferable ratio of the ion-conductive material to the base resin is with a range from 30:100 to 80:100.

Additionally, a preferable layer thickness of the resin layer 102 is within a range from 0.5 mm to 3 mm. If the resin layer 102 is thinner, molding is difficult and the strength may be insufficient. When the resin layer 102 is thicker, the charging roller 70 becomes larger accordingly, and an actual resistivity of the resin layer 102 may increase, which degrades the charging efficiency.

After the resin layer 102 is molded, the preliminarily-molded gap retaining members 103 are disposed on both sides of the resin layer 102 in the axial direction of the charging roller 70, which are both end portions in the axial direction of the metal core 101. Then, the gap retaining members 103 are fitted and/or bonded around the metal core 101, thus fixed to the metal core 101. By adjusting an external diameter of the charging roller 70 through cutting or grinding after the resin layer 102 and the gap retaining members 103 are united together, runout phases of the resin layer 102 and the gap retaining members 103 can be similar to each other. This method can reduce the fluctuation in the size of the gap between the charging roller 70 and the photoconductor 40.

Examples of the material for the gap retaining members 103 include resin such as polyethylene, polypropylene, polymethyl methacrylate, polystyrene, an acrylonitrile-butadiene-styrene copolymer, and polycarbonate. Because the gap retaining members 103 press against the outer surface, that is, a photoconductive layer, of the photoconductor 40, it is preferred that the material of the gap retaining members 103 should have a lower degree of hardness than the degree of hardness of the resin layer 102 to prevent damage to the photoconductive layer of the photoconductor 40. Polyacetal, ethylene ethyl acrylate copolymer, polyvinylidene fluoride, tetrafluoroethylene-PerFluoroAlkoxyethylene copolymer, tetrafluoroethylene-hexafluoropropylene copolymer can be also used because these resins have better sliding properties and accordingly are less likely to damage the photoconductive layer.

Additionally, the resin layer 102 and the gap retaining members 103 may be coated with an outer layer to which the toner does not easily adhere, whose layer thickness is about 10 μm.

By disposing the charging roller 70 so that the gap retaining members 103 contact the photoconductor 40 outside an image area, the gap can be retained between the photoconductor 40 and the resin layer 102 of the charging roller 70. Although not shown in the drawings, a gear attached to an end portion in the axial direction of the metal core 101 engages a gear formed on a flange of the photoconductor 40. As the photoconductor 40 rotates, driven by a photoconductor driving motor, not shown, the charging roller 70 rotates at a linear velocity similar to the rotation velocity of the photoconductor 40 in a direction similar to the rotation direction of the photoconductor 40 at the contact portion therebetween. At this time, because the gap is formed between the photoconductor 40 and the resin layer 102 (charging member) of the charging roller 70, that is, the charging roller 70 does not slidingly contact the surface of the photoconductor 40, the image area of the photoconductive layer can be protected from damage even when the resin layer 102 of the charging roller 102 is formed of a relatively hard resin and the photoconductor 40 is an organic photoconductor.

It is to be noted that, when the gap between the resin layer 102 and the photoconductor 40 is relatively large, abnormal electrical discharge can occur, which disenables uniform charging of the photoconductor 40. Therefore, it is preferred that the gap be not larger than about 100 μm. Additionally, when the charging roller 70 to be disposed across a space from the photoconductor 40 is used as in the present embodiment, it is preferable that the charging bias applied to the charging roller 70 be DC (direct current) voltage overlapped with AC (alternating current) voltage.

In the present embodiment, because the charging member (resin layer 102) and the gap retaining members 103 are formed of resin, processing is relatively easy and the charging roller 70 can be manufactured with a higher degree of accuracy.

Referring to FIG. 2, the cleaning roller 77 contacts the surface of the charging roller 70. The cleaning roller 77 can be melamine foam covering a metal core, disposed to contact the charging roller 70 with its own weight. As the charging roller 70 rotates, the cleaning roller 77 rotates while removing the toner, lubricant, etc., from the charging roller 70. Although the cleaning roller 77 may constantly contact the charging roller 70, in the configuration shown in FIG. 2, an engaging and disengaging member 77A such as a solenoid is connected to the cleaning roller 77 to move the cleaning roller 77 to engage and disengage from the charging roller 70. In such a configuration, the cleaning roller 77 can be moved to contact the charging roller 70 regularly or as required from a home position disengaged from the charging roller 70.

If the cleaning roller 77 contacts the charging roller 70 constantly, that is, the cleaning roller 77 slides on the charging roller 70 constantly, the toner, an additive to the toner, and the lubricant accumulated on the cleaning roller 77 might adhere to the surface of the charging roller 70 reversely over time. Therefore, causing the cleaning roller 77 to contact the charging roller 70 intermittently, not constantly, can enhance efficiency in removal of the toner and the like from the charging roller 70 as well as prevent or inhibit the accumulation on the cleaning roller 77 from adhering to the charging roller 70.

The two-component developer including the toner and the magnetic carrier used in the present embodiment is described in further detail below.

Main components of the toner are a binder resin, a colorant, and a charge adjustment agent, and other additive may be added as required. Examples of the binder resin include polystyrene, a styrene-acrylate co-polymer, and polyester resin. Various known colorants for toner can be used in the present embodiment. The weight ratio of the colorant to the binder resin is within a range from 0.1:100 to 15:100, for example. Examples of the charge adjustment agent include nigrosine dye, complexes include chrome, and fourth grade ammonium salt, and these are selectively used depending on the polarity of the toner particles. The weight ratio of the charge adjustment agent to the binder resin is within a range from 0.1:100 to 10:100, for example. Further, it is preferable that the toner should include a fluidity adding agent such as fine particles of metal oxide, surface-processed fine particles of metal oxide, and fine particles of polymer. A preferable particle diameter of the fluidity adding agent is within a range from 0.01 μm to 3 μm, and a preferable weight ratio of the fluidity adding agent to the toner particles is within a range from 0.1:100 to 7.0:100.

The toner for the two-component developer used in the present embodiment can be manufactured through various known methods or a combination thereof.

A typical magnetic carrier is a core member or a core member covered with a cover layer.

Next, the photoconductor 40 is described in further detail below

Figure 7:
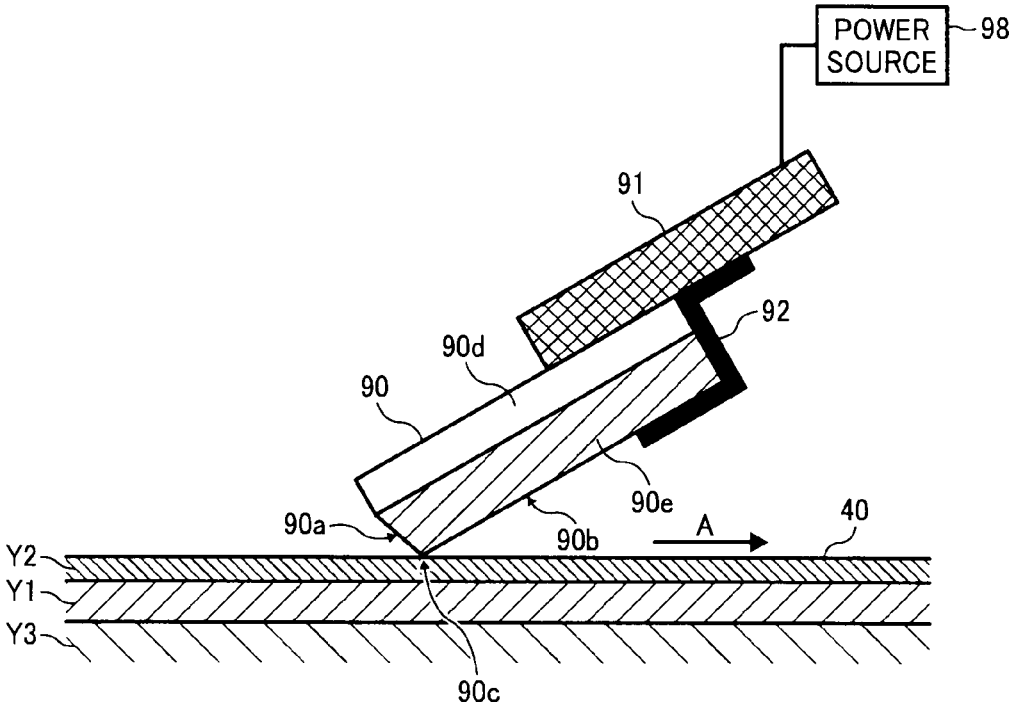
FIG. 7 illustrates a support structure to support an electroconductive blade according to an illustrative embodiment.

For example, the photoconductor 40 can be a multilayered organic photoconductor including an electrically conductive support member Y3 and the photoconductive layer formed Y1 on the support member Y3 (shown in FIG. 7).

The conductive support member Y3 is formed of a material having a volume resistivity not greater than $10^{10}$ Ω·cm as electrical conductivity. For example, the conductive support member Y3 can be formed by coating metal such as aluminum, nickel, chrome, nichrome, copper, silver, gold, and platinum; or metal oxide such as tin oxide and oxidation indium on cylindrical plastic, cylindrical paper, plastic film, or paper film through vapor deposition or sputtering. Alternatively, a pipe formed of aluminum, aluminum alloy, nickel, or stainless steel can be cut and then super finish or polishing can be performed on its surface.

The photoconductive layer Y1 includes a charge generation layer and a charge transport layer. A main component of the charge generation layer is a charge generation material that is either organic or inorganic. To produce the charge generation layer, the charge generation material together with a binder resin, as required, are dispersed into solvent, and then the dispersed liquid is applied to the conductive support member. Alternatively, the charge generation layer can be produced through known vacuum thin-film forming methods. The layer thickness of the charge generation layer is typical within a range from 0.01 μm to 5 μm and is preferably within a range from 0.1 μm to 2 μm.

The charge transport layer can be formed by dissolving or dispersing a charge transport material together with a binder resin in solvent, applying the solution onto the conductive support member, and drying it. An elasticizer and/or a leveling agent may be added thereto. Low-molecular materials that are either electron transport materials or positive-hole transport materials can be used as the charge transport material. The layer thickness of the charge transport layer can be set within a range from 10 μm to 40 μm depending on desired photoconductive properties.

As the elasticizer, general-purpose plasticizer for resin such as dibutyl phthalate and dioctyl phthalate can be used, and a weight ratio of the elasticizer to the binder resin is with a range from 0 to 30%. As the leveling agent, silicone oil such as dimethyl silicone oil and methylphenyl silicone oil; polymer having a perfluoroalkyl group as lateral chains; or oligomers can be used. A weight ratio of the leveling agent to the binder resin is within a range from 0 to 1%.

In the present embodiment, a preferable content of the charge transport material in the charge transport layer is 30 weight percents or greater. If the content is lower than 30 weight percent, a sufficient optical attenuation time for high-speed electrophotographic process cannot be available when pulsed light is applied to the photoconductor 40 in optical writing.

Additionally, a base coat can be formed between the conductive support member Y3 and the photoconductive layer Y1. A main component of the base coat can be resin, preferably resin that is resistive to typical organic solvent. Fine particles of metal oxide may be added to the base coat to prevent moire and/or reduce residual electrical potential. The base layer can be formed using a given solvent through a given coating method similarly to the photoconductive layer described above. A preferable layer thickness of the base coat is 0μ to 5 μm, for example.

Further, an abrasion-resistive protective layer Y2 can be formed on the photoconductive layer Y1 to protect the photoconductive layer and to enhance durability thereof. With such an abrasion-resistive protective layer Y2, wear of the surface of the photoconductor 40 can be significantly reduced, and the operational life of the photoconductor 40 can be significantly expanded at a relatively low cost. In the protective layer Y2, fine particles of oxide of metal such as alumina, silica, titanium, tin, zirconia, and/or indium can be added to a binder resin to improve the durability. Examples of the binder resin include styrene-acrylonitrile co-polymer, styrene-butadiene co-polymer, acrylonitrile-butadiene-styrene co-polymer, olefin-vinyl monomer co-polymer, chlorination polyether, allyl, phenol, polyacetal, polyamide, polyamide imide, polyacrylate, polyallylsulfone, polybutylene, polybutylene terephthalate, polycarbonate, polyether sulfone, polyethylene, polyethylene terephthalate, polyimide, acrylic, poly methyl pentene, polypropylene, polyphenylene oxide, polysulfone, polyurethane, polyvinyl chloride, polyvinylidene chloride, and epoxy.

The weight ratio of the metal oxide fine particles in the protective layer Y2 can be within a range from 5% to 30%. If this weight ratio is lower than 5%, improvement of the abrasion resistivity will be insufficient. If this weight ratio is greater than 30%, in optical writing, electrical potential in a white portion may increase in such an extent that the sensitivity decreases significantly. The protective layer Y2 can be produced through typical coating methods such as spraying. The layer thickness of the protective layer Y2 may be within a range from 1 μm to 10 μm and preferably within a range from 3 μm to 8 μm. The durability may be insufficient if the protective layer Y2 is thinner. By contrast, if the protective layer Y2 is thicker, productivity in manufacturing the photoconductors will decrease, and simultaneously, residual potential may increase significantly over time. The particle diameter of the metal oxide fine particles added to the protective layer Y2 can be within a range from 0.1 μm to 0.8 μm. If the particle diameter is larger, unevenness of the surface of the photoconductor 40 may increase in such an extent that the photoconductor 40 cannot be cleaned sufficiently. In addition, such significant surface unevenness can scatter the exposure light, thus reducing the resolution, which results in substandard images. By contrast, if the particle diameter of the metal oxide fine particles is smaller, the abrasion resistivity may be insufficient.

Additionally, the protective layer Y2 may include a dispersion aid, such as typical dispersion aids used in paint, to enhance dispersion of the metal oxide fine particles in the base resin. The weight ratio of the dispersion aid to the fine particles can be within a range from 0.5% to 4% and preferably within a range from 1% to 2%.

Further, a charge transport material, similar to those used in the charge transport layer, may be added to the protective layer to enhance transport of the electrical charge in the protective layer.

Additionally, each layer of the photoconductor 40 used in the present embodiment can include an antioxidant, a plasticizer, ultraviolet-ray absorbent, and/or leveling agent to prevent the decrease in the sensitivity and particularly to prevent the increase in the residual potential.

It is to be noted that, the protective layer Y2 used in the present embodiment is not limited to the above-described layer in which metal oxide fine particles are disposed. Protective layers using an optical plastic or thermoplastic resin can be used in the present embodiment as well.

Description will be made below of adjustment of the polarity of the toner, which is performed to reduce adherence of the toner to the charging roller, is described below.

When the charging roller 70 is disposed across a small gap from the surface of the photoconductor 40 as in the present embodiment, the gap, that is, the distance between the charging roller 70 and the surface of the photoconductor 40, fluctuates as the charging roller 70 and the photoconductor 40 rotate. To charge the photoconductor 40 uniformly without adverse effects of the fluctuation in the gap, the charging bias applied to the charging roller 70 is preferably DC voltage overlapped with AC voltage as described above. However, when the DC voltage overlapped with AC voltage is applied to the charging roller 70, the toner, etc. on the photoconductor 40 can fly over the gap and adhere to the charging roller 70 electrostatically.

Therefore, in the present embodiment, another bias (hereinafter "polarity adjustment bias") is applied to an electroconductive blade 90, shown in FIG. 7, disposed to contact the circumferential surface of the photoconductor 40 so as to adjust the polarity of the toner, etc., adhering to the photoconductor 40. The electroconductive blade 90 to which the polarity adjustment bias is applied can be used as the cleaning blade 75 in the configuration shown in FIG. 2. In the configuration shown in FIG. 3, electroconductive blade 90 can be used as the cleaning blade 75 or the lubricant regulation blade 80, and adhesion of the excessive lubricant in addition to the toner to the charging roller 70 can be reduced when the polarity adjustment bias is applied to the lubricant regulation blade 80. In the present embodiment, the polarity adjustment bias is a voltage that has a polarity identical to that of the charging bias to charge the photoconductor 40 by the charging roller 70 (hereinafter "photoconductor charging bias") and is greater than a discharge start voltage at which electrical discharge is started between the electroconductive blade 90 and the surface of the photoconductor 40.

Applying the polarity adjustment bias, having the polarity identical to that of the photoconductor charging bias, greater than the discharge Start voltage to the electroconductive blade 90 can cause electrical discharge between the electroconductive blade 90 and the surface of the photoconductor 40. This electrical discharge generates ions whose polarity is identical to the photoconductor charging bias, and then the ions adhere to the toner, etc., on the photoconductor 40, which causes the polarity of the toner, etc., to be identical to that of the photoconductor charging bias. When the polarity of the toner, etc., on the photoconductor 40 and the polarity of the photoconductor charging bias are identical, electrostatic repulsion is present between the charging roller 70 and the toner, etc., entering a portion facing the charging roller 70 (e.g., gap between the charging roller 70 and the photoconductor 40). Thus, the toner, etc., can be prevented from electrostatically adhering to the charging roller 70. In addition, by using the electroconductive blade 90 instead of a roller or the like, the polarity of the particles can be adjusted more efficiently and the apparatus can be smaller.

In the present embodiment, electrical discharge between the electroconductive blade 90 and the surface of the photoconductor 40 is started at a voltage within a range from about −500 V to about −800 V (discharge start voltage), and a constant-voltage controlled voltage within a range from about −1200 V to about −1500 V is applied to the electroconductive blade 90 as the polarity adjustment bias. Alternatively, constant-current control may be adopted in bias application to the electroconductive blade 90.

If the polarity adjustment bias is lower than the discharge start voltage, electrical discharge does not occur between the electroconductive blade 90 and the photoconductor 40, and thus no ion is generated therebetween. Accordingly, the polarities of the particles of the toner, etc., on the photoconductor 40 cannot be adjusted to an identical polarity, which means that particles whose polarity is opposite the polarity of the photoconductor charging bias will electrostatically adhere to the charging roller 70. Therefore, the polarity adjustment bias applied to the electroconductive blade 90 should be greater than the discharge start voltage to prevent or reduce the electrostatic adhesion of the particles (e.g., toner, lubricant, paper dust, etc).

This electrical discharge generates ions whose polarity is identical to the photoconductor charging bias, and then the ions adhere to the toner, etc., on the photoconductor 40, which causes the polarity of the toner, etc., to be identical to the polarity of the photoconductor charging bias.

The electroconductive blade 90 is described in further detail below with reference to FIG. 7.

Referring to FIG. 7, the electroconductive blade 90, which can be used as the cleaning blade 75 shown in FIG. 2 or the lubricant regulation blade 80 shown in FIG. 3, is formed of rubber, such as polyurethane, that is typically used for cleaning blades, and an electroconductive agent that can be either electron conductive or ion conductive is added to the rubber to make the blade conductive. The electroconductive blade 90 is supported by an electroconductive holder 91 that can be formed of metal, and the polarity adjustment bias is applied to the holder 91 from a power source 98 disposed in the main body of the image forming apparatus 1 shown in FIG. 1.

As electrical resistivity, the electroconductive blade 90 preferably has a volume resistivity within a range from $10^4$ Ω·cm to $10^9$ Ω·cm to charge the toner that has passed the electroconductive blade 90 with the electrical discharge generated between the electroconductive blade 90 and the surface of the photoconductor 40. The thickness of the electroconductive blade 90 can be within a range from 1.5 mm to 2.5 mm similarly to other cleaning blades used in the cleaning devices, considering that the electroconductive blade 90 is also used to clean the surface of the photoconductor 40 or to apply lubricant onto the surface of the photoconductor 40.

A support structure to support the electroconductive blade is described below.

Figure 5:
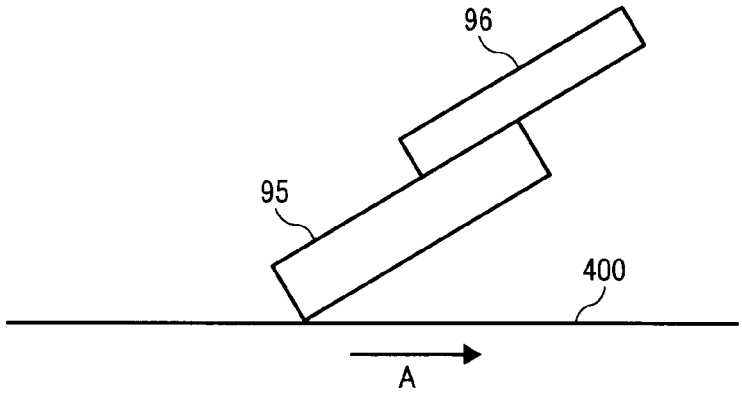
FIG. 5 illustrates a blade member bonded to a metal holder.

FIG. 5 illustrates a blade member 95, which is an example of electrically insulative blade members such as cleaning blades, and a reference character A represents a moving direction of the surface that the blade member 95 contacts. Referring to FIG. 5, the blade member 95 is typically bonded to a metal holder 96 with electrically insulative adhesive.

FIG. 7 illustrates the support structure to support the electroconductive blade 90 according to the present embodiment.

Referring to FIG. 7, the electroconductive blade 90 is bonded to the metal holder 91 as well. However, merely bonding electroconductive blade members to metal holders with electrically insulative adhesive cannot attain electrical continuity between the holder and the electroconductive blade member. Moreover, adding electroconductive agent to blade members might degrade adhesiveness of the blade member itself, resulting in insufficient bonding strength between the blade member and the holder. Although, instead, electroconductive double-sided adhesive tape may be used to bond the electroconductive blade member to the holder to attain electrical continuity therebetween, the bonding strength might not be sufficient for the electroconductive blade member to serve as a cleaning blade.

Therefore, in the present embodiment, the electroconductive blade 90 is multilayered including at least an electrical insulation layer 90*d* and an electroconductive layer 90*e* as shown in FIG. 7. By bonding together the holder 91 and the insulation layer 90*d* of the electroconductive blade 90, the electroconductive blade 90 can be securely fixed to the holder 90. Additionally, coupling the holder 91 and the conductive layer 90*e* using an electroconductive member 92 can attain the electrical continuity between the holder 91 and the electroconductive blade 90. The electroconductive member 92, which can be electroconductive tape, electroconductive coating layer, or the like, should have an electrical resistivity (volume resistivity) lower than that of the conductive layer 90*e* of the electroconductive blade 90. With this configuration, the polarity adjustment bias applied to the holder 91 from the power source 98 can be reliably applied to the conductive layer 90*e* of the electroconductive blade 90.

It is to be noted that, instead of bonding the electroconductive blade 90 to the holder 91 with adhesive, the metal holder 91 may include an engagement portion that engages the electroconductive blade 90 so that the electroconductive blade 90 can be fixed to the holder 91 with the electrical continuity between the holder 91 and the electroconductive blade 90 maintained. In such a case, a single-layered blade member including the conductive layer can be used as the electroconductive blade 90.

Additionally, in the present embodiment, as shown in FIG. 7, the electroconductive blade 90 is supported to contact the surface of the photoconductor 40 in a counter supporting method. More specifically, the portion of the electroconductive blade 90 that contacts the surface of the photoconductor 40 is a blade edge or corner portion 90*c* formed between a blade tip surface 90*a* and a blade lower surface 90*b* that faces the surface of the photoconductor 40, and where the holder 91 holds the electroconductive blade 90 is located downstream from a portion where the corner portion 90*c* contacts the surface of the photoconductor 40 in the rotation direction of the photoconductor 40. By contrast, a trailing supporting method refers to supporting the electroconductive blade 90 downstream from the portion where the electroconductive blade 90 contacts the photoconductor 40 in the rotation direction of the photoconductor 40. The counter supporting method can press the electroconductive blade 90 against the surface of the photoconductor with a higher pressure than the trailing supporting method does. Therefore, the electroconductive blade 90 can catch the toner, etc. entering between the electroconductive blade 90 and the photoconductor 40 more reliably, reducing the toner escaping from it.

A comparative example of the blade edge of the blade member that contacts the surface of the photoconductor is described below with reference to FIG. 6.

Figure 6:
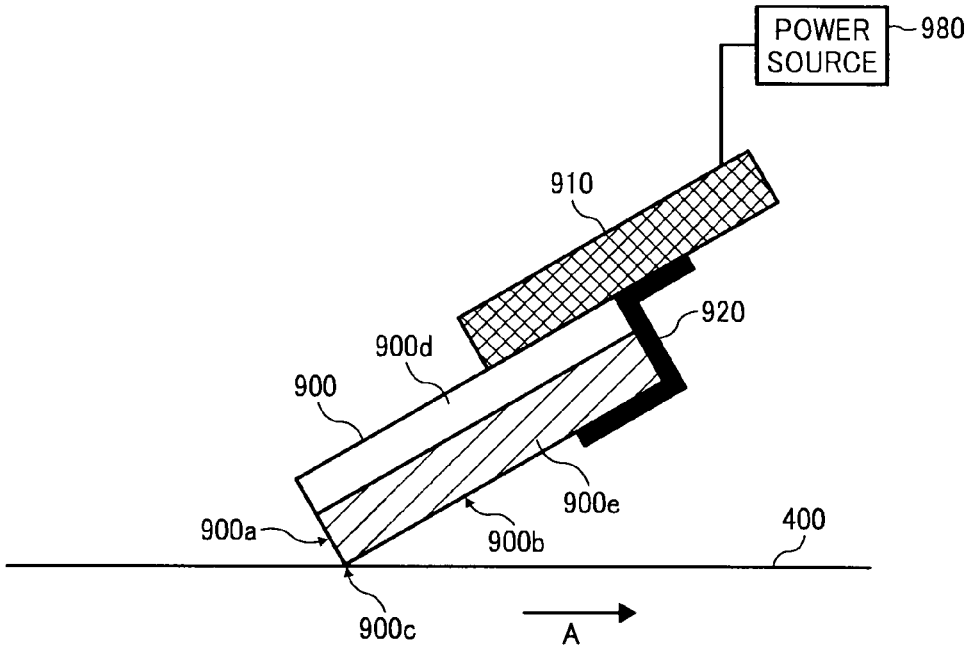
FIG. 6 illustrates a blade member according to a comparative example whose right-angled blade edge contacts a surface of a photoconductor.

Referring to FIG. 6, a blade member 900 including an electrical insulation layer 900*d* and an electroconductive layer 900*e* is supported by a holder 910 similarly to the configuration shown in FIG. 7. However, a blade edge 900*c* of the blade member 900 that contacts the photoconductor 400 and is formed between a lower surface 900*b* facing the photoconductor 400 and a tip surface 900*a* is right-angled. In such a configuration, the right-angled blade edge 900*c* is likely to curl, drawn by the photoconductor 400 in the rotation direction indicated by arrow A. Then, stick slip, meaning that the blade member 900 repeatedly sticks to and slips on the photoconductor 400 as the photoconductor 400 rotates, will occur, and the blade member 900 will vibrate.

By contrast, in the present embodiment, because the blade edge 90*c* that contacts the surface of the photoconductor 40 is obtuse-angled as shown in FIG. 7, the blade edge 90*c* is less likely to curl. Thus, the blade edge 90*c* can stably contact the photoconductor 40 with less vibration, reducing the leakage of the toner, lubricant, etc. from the contact portion between the electroconductive blade 90 and the photoconductor 40. A preferable angle of the blade edge 90*c* can be within a range from 100 degrees to 140 degrees. When the corner of the multilayered electroconductive blade 90 including the electrical insulation layer 90*d* and an electroconductive layer 90*e* is cut to make the obtuse-angled blade edge 90*c*, it is difficult to cut both of these layers accurately simultaneously because they are formed of the materials having different properties. Therefore, as shown in FIG. 7, only the conductive layer 90*e* is cut to make the obtuse-angled blade edge 90*c* with a higher degree of accuracy.

Additionally, because the obtuse-angled blade edge 90*c* can contact the surface of the photoconductor 40 stably with less vibration, stabilizing the discharge occurring between the electroconductive blade 90 and the photoconductor 40, the toner, the lubricant, and the like that pass the contact portion between the electroconductive blade 90 and the photoconductor 40, although the amount of which may be smaller, can be charged better by the discharge occurring at the exit of the contact portion.

Generally, when only the DC bias voltage is applied to roller-shaped members, discharge occurs mainly at the entrance of the contact portion between the photoconductor and the roller-shaped member. Because the photoconductor has been charged already when arriving at the exit of the contact portion, the bias voltage does not exceed the discharge start voltage, and accordingly discharge rarely occurs.

By contrast, as in the present embodiment, when the electroconductive blade 90 contacts the surface of the photoconductor 40 in the counter direction and used as the cleaning blade (75 shown in FIG. 2) or the lubricant regulation blade (80 shown in FIG. 3), the toner, the lubricant, and the like removed from the photoconductor 40 accumulate at the entrance of the contact portion. The accumulation inhibits occurrence of discharge at the entrance of the contact portion, and discharge can occur at the exit of the contact portion, thus effectively charging the toner, the lubricant, etc. that has passed the contact portion.

Moreover, physical adherence of the particles (toner, lubricant, etc.) to the charging roller 70 can be inhibited because the charging roller 70 is disposed across a space from the photoconductor 40 in the present embodiment.

By contrast, as an comparative example, in a cleaner-less image forming apparatus including no cleaning member to clean the surface of the photoconductor, a charge adjustment member charges the residual toner to have a polarity identical to that of the photoconductor charging bias upstream from the portion (e.g., charging portion) where the photoconductor is charged in the rotation direction thereof, and then the development device collects the residual toner whose polarity has been adjusted. In such a configuration, a larger amount of toner particles, external additive particles, etc. may pass the charging portion. Therefore, it is possible that a relatively large amount of particles may physically adhere to the charging roller that contacts the photoconductor even if the polarity of the particles is electrostatically adjusted to such a polarity that they are not electrostatically attracted to the charging roller, that is, to the polarity of the photoconductor charging bias by the charging roller.

By contrast, when the DC voltage overlapped with AC voltage is applied to the charging roller as the charging bias, discharge occurs more actively between the photoconductor and the charging roller, and thus the surface of the photoconductor can be activated more easily than when only DC voltage is applied to the charging roller. When the cleaning member slidingly contacts the surface of the photoconductor in this state, wear of the photoconductor increases. Therefore, the surface of the photoconductor is lubricated to reduce the frictional resistivity between the cleaning member and the photoconductor, thus reducing the wear of the photoconductor. Brush rollers to apply powder lubricant scrape off from solid lubricant members onto the surface of the photoconductor are often used to lubricate the surface of the photoconductor. Then, the lubricant regulation member (e.g., doctor blade) distributes the lubricant across the surface of the photoconductor, thus forming a thin lubricant layer thereon.

However, it is possible that a certain amount of powder lubricant may pass through the contract portion between the lubricant regulation member and the photoconductor and then adhere to the charging roller. In this case, although a cleaning member to clean the charging roller physically may be provided, the cleaning member might fail to remove powder lubricant from the charging roller and, on the contrary, distribute the lubricant across the charging roller into a thin lubricant layer, resulting in an increase in the stain on the charging roller.

In view of the foregoing, in the present embodiment, instead of or in addition to providing a cleaning member to clean the charging roller 70, the charging roller 70 is disposed across a gap from the photoconductor 40 and the polarity of the particles adhering on the surface of the photoconductor is adjusted so that the particles are not likely to electrostatically adhere to the charging roller. By thus inhibiting the adherence of the particles to the charging roller, charging failure can be reduced efficiently.

As described above, in the present embodiment, the charging roller 70 (charging device) is disposed so that the charging layer 102 (charging member) is across the predetermined gap from the surface of the photoconductor 40. Therefore, particles, such as toner and lubricant, adhering to the photoconductor 40 can be prevented or inhibited from physically adhering to the charging roller 70. In addition, the electroconductive blade 90 (cleaning blade 75 in FIG. 2 or lubricant regulation blade 80 in FIG. 3) is disposed upstream from the brush roller 73 (first cleaning member) and downstream from the primary transfer roller 12 (transfer unit) in the rotation direction of the photoconductor 40. The electroconductive blade 90 and the power source 98 together form the polarity adjustor that adjusts the polarities of the particles to be identical to the polarity of the charging bias to charge the photoconductor 40 by the charging roller 70. Adjusting the polarity of the particles on the photoconductor 40 to be identical to the polarity of the photoconductor charging bias can cause electrostatic repulsion between the charging roller 70 and the particles on the photoconductor 40, which can prevent or inhibit the particles from electrostatically adhering to the charging roller 70. Therefore, the charging roller 70 can be kept clean for a longer time period, reducing charging failure, and accordingly desirable degree of image quality can be maintained for a longer time period.

Using the electroconductive blade 90 as one of the cleaning members can recue the number of the cleaning members. When the brush roller 74 (lubricant application member) to lubricate the photoconductor 40 is disposed upstream from the electroconductive blade 90 and downstream from the primary transfer roller 12 in the rotation direction of the photoconductor 40, the electroconductive blade 90 can distribute the lubricant applied by the brush roller 74 across the surface of the photoconductor 40. Thus, the electroconductive blade 90 can serve as the lubricant regulation member, unnecessitating a separate lubricant regulation member. Thus, the size as well as the cost of the apparatus can be reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image carrier to carry a toner image thereon;

a charging device to charge a surface of the image carrier, disposed across a predetermined gap from the surface of the image carrier;

a latent image forming device to form a latent image on the charged surface of the image carrier;

a developing device to develop the latent image with toner into a toner image;

a transfer unit to transfer the toner image from the image carrier onto a sheet of recording media;

a first cleaning member to clean the surface of the image carrier after the toner image is transferred therefrom;

a lubricant application member to apply lubricant onto the surface of the image carrier; and a polarity adjustor to adjust polarities of the toner and lubricant adhering to the image carrier to be identical to a polarity of a charging bias with which the charging device charges the image carrier, wherein the polarity adjustor is disposed facing the image carrier, upstream from the charging device and downstream from the transfer unit in a direction in which the image carrier rotates, wherein the polarity adjustor comprises an electroconductive blade disposed to contact the surface of the image carrier and a bias applicator to apply a polarity adjustment bias to the electroconductive blade, wherein the polarity adjustment bias has a polarity identical to the polarity of the charging bias to charge the image carrier and is greater than a discharge start voltage at which discharge is started between the electroconductive blade and the surface of the image carrier, and wherein the lubricant application member is disposed upstream from the electroconductive blade and downstream from the transfer unit in the direction in which the image carrier rotates.

2. The image forming apparatus according to claim 1, further comprising an electroconductive blade holder to support the electroconductive blade while an edge portion of the electroconductive blade contacts the surface of the image carrier, and an electroconductive member to electrically connect the electroconductive blade and the blade holder, wherein the electroconductive blade is multilayered including an electroconductive layer that contacts the surface of the image carrier and an electrically insulative layer fixed to the blade holder, and the bias applicator applies the polarity adjustment bias to the electroconductive layer of the electroconductive blade via both the blade holder and the electroconductive member.

3. The image forming apparatus according to claim 1, wherein the electroconductive blade contacts the surface of the image carrier at an angle counter to the direction in which the image carrier rotates, and an edge portion of the electroconductive blade that contacts the surface of the image carrier forms an obtuse angle between a blade lower surface facing the photoconductor and a blade tip surface.

4. The image forming apparatus according to claim 3, wherein the electroconductive layer is cut to produce the obtuse-angled edge portion of the electroconductive blade that contacts the surface of the image carrier.

5. The image forming apparatus according to claim 1, wherein the electroconductive blade is used as a second cleaning member to clean the surface of the image carrier.

6. The image forming apparatus according to claim 1, wherein the lubricant comprises zinc stearate.

7. The image forming apparatus according to claim 1, wherein the image carrier is an organic photoconductor comprising a photoconductive layer and a surface layer to protect the photoconductive layer.

8. The image forming apparatus according to claim 1, wherein the charging device comprises:

a metal core;

a charging layer including an electroconductive resin material, formed on the metal core; and gap retaining members respectively disposed on both end portions of the metal core in an axial direction of the charging device to maintain the predetermined gap between the charging member and the image carrier, the gap retaining members comprising an electrically insulative resin material.

9. The image forming apparatus according to claim 1, further comprising:

a charging cleaning member to clean the charging device; and an engaging and disengaging member to engage and disengage the charging cleaning member from the charging device.

10. An image forming apparatus, comprising:

an image carrier to carry a toner image thereon;

a charging device to charge a surface of the image carrier, disposed across a predetermined gap from the surface of the image carrier;

a latent image forming device to form a latent image on the charged surface of the image carrier;

a developing device to develop the latent image with toner into a toner image;

a transfer unit to transfer the toner image from the image carrier onto a sheet of recording media;

a first cleaning member to clean the surface of the image carrier after the toner image is transferred therefrom;

a lubricant application member to apply lubricant onto the surface of the image carrier; and a polarity adjustor to adjust polarities of the toner and lubricant adhering to the image carrier to be identical to a polarity of a charging bias with which the charging device charges the image carrier, wherein the polarity adjustor is disposed facing the image carrier, upstream from the charging device and downstream from the transfer unit in a direction in which the image carrier rotates, wherein the polarity adjustor comprises an electroconductive blade disposed to contact the surface of the image carrier and a bias applicator to apply a polarity adjustment bias to the electroconductive blade, wherein the polarity adjustment bias has a polarity identical to the polarity of the charging bias to charge the image carrier and is greater than a discharge start voltage at which discharge is started between the electroconductive blade and the surface of the image carrier, and wherein the lubricant application member is disposed downstream from the first cleaning member and upstream from the charging device in the direction in which the image carrier rotates, wherein the electroconductive blade is disposed downstream from the lubricant application member and upstream from the charging device in the direction in which the image carrier rotates, and wherein the electroconductive blade serves as a lubricant regulation member to distribute the lubricant supplied by the lubricant application member uniformly across the surface of the image carrier.

11. An image forming apparatus, comprising:

an image carrier to carry a toner image thereon;

a charger to charge a surface of the image carrier, disposed across a predetermined gap from the surface of the image carrier;

a latent image forming device to form a latent image on the charged surface of the image carrier;

a developer to develop the latent image with toner into a toner image;

a cleaner to clean the surface of the image carrier after the toner image is transferred therefrom;

a lubricant applicator to apply lubricant onto the surface of the image carrier; and polarity adjustment means for adjusting polarities of the toner and lubricant adhering to the image carrier to be identical to a polarity of a charging bias with which the charger charges the image carrier, the polarity adjustment means disposed facing the image carrier, upstream from the charging device and downstream from a position at which the toner image is transferred in a direction in which the image carrier rotates, wherein the polarity adjustment means comprises an electroconductive blade which contacts the surface of the image carrier and a bias applicator to apply a polarity adjustment bias to the electroconductive blade, wherein the polarity adjustment bias has a polarity identical to the polarity of the charging bias to charge the image carrier and is greater than a discharge start voltage at which discharge is started between the electroconductive blade and the surface of the image carrier, and wherein the image forming apparatus further comprises a transfer device to perform the transfer of the toner image from the image carrier, and wherein the lubricant applicator is disposed upstream from the electroconductive blade and downstream from the transfer device in the direction in which the image carrier rotates.

12. The image forming apparatus according to claim 11, further comprising an electroconductive blade holder to support the electroconductive blade while an edge portion of the electroconductive blade contacts the surface of the image carrier, and an electroconductive member to electrically connect the electroconductive blade and the blade holder, wherein the electroconductive blade is multilayered including an electroconductive layer that contacts the surface of the image carrier and an electrically insulative layer fixed to the blade holder, and the bias applicator applies the polarity adjustment bias to the electroconductive layer of the electroconductive blade via both the blade holder and the electroconductive member.

13. The image forming apparatus according to claim 11, wherein the electroconductive blade contacts the surface of the image carrier at an angle counter to the direction in which the image carrier rotates, and an edge portion of the electroconductive blade that contacts the surface of the image carrier forms an obtuse angle between a blade lower surface facing the photoconductor and a blade tip surface.

14. The image forming apparatus according to claim 13, wherein the electroconductive layer includes the obtuse-angled edge portion of the electroconductive blade that contacts the surface of the image carrier.

15. The image forming apparatus according to claim 11, wherein the electroconductive blade is used as a second cleaner to clean the surface of the image carrier.

16. The image forming apparatus according to claim 11, wherein the lubricant application member is disposed downstream from the cleaner and upstream from the charging device in the direction in which the image carrier rotates, the electroconductive blade is disposed downstream from the lubricant applicator and upstream from the charger in the direction in which the image carrier rotates, and the electroconductive blade serves as a lubricant regulation member to distribute the lubricant supplied by the lubricant applicator uniformly across the surface of the image carrier.

* * * * *